United States Patent [19]

Stockwell

[11] Patent Number: 4,663,617

[45] Date of Patent: May 5, 1987

[54] GRAPHICS IMAGE RELOCATION FOR DISPLAY VIEWPORTING AND PEL SCROLLING

[75] Inventor: Dean A. Stockwell, West Hurley, N.Y.

[73] Assignee: International Business Machines, Armonk, N.Y.

[21] Appl. No.: 582,202

[22] Filed: Feb. 21, 1984

[51] Int. Cl.[4] ..... G09G 1/00

[52] U.S. Cl. ..... 340/726; 340/724; 340/721

[58] Field of Search ..... 340/709, 724, 726, 723, 340/721

[56] References Cited

U.S. PATENT DOCUMENTS

| | | | |
|---|---|---|---|
| 4,197,590 | 4/1980 | Sukonick et al. | 340/726 X |
| 4,271,479 | 6/1981 | Cheselka et al. | 364/900 |
| 4,437,093 | 3/1984 | Bradley | 340/726 |
| 4,442,495 | 4/1984 | Sukonick | 340/726 X |
| 4,491,834 | 1/1985 | Oguchi | 340/726 |
| 4,517,654 | 5/1985 | Carmean | 340/726 X |

*Primary Examiner*—Gerald L. Brigance
*Attorney, Agent, or Firm*—Frederick D. Poag; Wenderoth, Lind & Ponack

[57] ABSTRACT

By selecting the starting time of the display readout of a pel buffer raster generation, the pel data is mapped to a display screen with an arbitrary displacement with respect to the screen for relocation or scrolling of the pel image on the screen. To compensate for non-congruency between the pel data window and screen viewport definitions and to provide scrolling on a pel basis, the positioning of the window on the screen includes fine adjustment achieved by a determinable delay between the scanning of the buffer and the generation of the screen raster. The display circuits include means to extend the window background to fill in gaps between the edges of a window of pel data chosen to be displayed and a larger screen viewport in which it is to be displayed. System read/write access times to the buffer are interleaved with and synchronized to the data fetch times of the display.

4 Claims, 9 Drawing Figures

| | |
|---|---|
| FIG.3A | FIG.3B |
| FIG.3C | FIG.3D |

GRAPHICS IMAGE RELOCATION FOR DISPLAY VIEWPORTING AND PEL SCROLLING

BACKGROUND OF THE INVENTION

1. Field of the Invention

This invention relates to viewporting and scrolling in a display having an all points addressable graphic display capability.

2. Prior Art

It has been known to provide a multiple data window display for displaying data from independent application programs in a multi-tasking environment on a common display screen. In one such prior system, plural screen buffers are provided for storing scan image defining data, and control means have been provided for selectively coupling the output of a given single one of the plural screen buffers to video means at any given time so that at any given point on the display screen, the data displayed originates from a selected one of the screen buffers. If, in such a system, the screen buffers operate synchronously and can be accessed on the same bases, for example, on a byte basis, a composite screen picture can be assembled from segments of the selected screen buffers without overlaps or gaps in the resulting mosaic picture. Systems of the foregoing kind are shown and described in U.S. patent application Ser. Nos. 542,572 and 542,376, filed Oct. 17, 1983.

A problem exists however where the buffers operate under the control of systems in which data is accessed differently, for example, on 9-bit byte boundaries from one system and 16-bit half word boundaries from another system. A problem of this kind can arise where the screen is notionally divided into "character boxes" 9 bits wide for accommodating alphanumeric characters designed for a 9-bit wide format, but where pel data for all points addressable (APA) graphic presentation is derived from a different system having a pel buffer organized around 8-bit bytes and 16-bit half words, so that congruency between the two systems can be achieved only on boundaries which are divisible both by 9 and 16. The smallest string of pels which could be brought into exact registration from two buffers in such a system would be nine 16-bit half word and sixteen 9-bit bytes. Thus if an effort were made to fit pel data from 16-bit half words into a viewport on the screen defined by 9-bit wide character boxes or spaces, only rarely would the pel data exactly fit. Therefore, if the whole of the APA window data is to be shown within the screen viewport, there arise occasions when a portion of the viewport is unfilled by the smaller window of data, leaving a gap on the screen, distracting from the appearance of the display.

Another problem arising from mismatch of system parameters, arises when scrolling on a pel basis is desired. Scrolling is frequently useful where the screen viewport is smaller than the body of data to be shown, so that the user desires to, in effect, move the viewport across the body of data so that the data appears to scroll within the viewport. If the viewport and the data are organized on different radices as above described, the scrolling system must take account of both in the fetching of data to be shown and the moving of it into changeable, or constantly changing, relationships to the viewport.

A third problem arising in systems as above described is in adjusting the overall timing of both systems so that input/output operations with respect to the pel buffer can be facilitated and yet the desired image registration maintained.

SUMMARY OF THE INVENTION

The present invention provides an improvement in prior systems such as the aforecited U.S. application Ser. Nos. 542,572 and 542,576.

According to one aspect of the invention a method and means of operating a display system for displaying a window of data from a pel buffer in a viewport on a display screen is provided wherein the dimensions of the viewport are chosen to be at least as large as the window of data to be displayed at any one time and offset is provided on both window data address boundaries and pel designations within an address to provide the desired registration between the windowed data and the viewport on the screen.

In accordance with another aspect of the invention a method and means are provided to fill in any gap between the window of data being displayed and a boundary of the viewport on the display screen, by extending pel background of the windowed data to the boundary of such viewport.

Still another aspect of the invention is to provide independent timing means for input/output addressing of a pel buffer and scanning means for transferring pel information from that buffer to the display screen, and synchronization of the two timing means.

Accordingly a general object of the invention is to provide a display system having improved buffer control means for providing flexibility to adapt the display of data from a pel source to a screen arrangement organized on a different radix and also to provide pel position adjustment for accommodation of the difference in radices and enabling scrolling in both horizontal and vertical directions on a pel basis.

Other objects and advantages of the invention will be apparent from the specification as a whole, and from the claims appended hereto.

DETAILED DESCRIPTION

Figure 1:
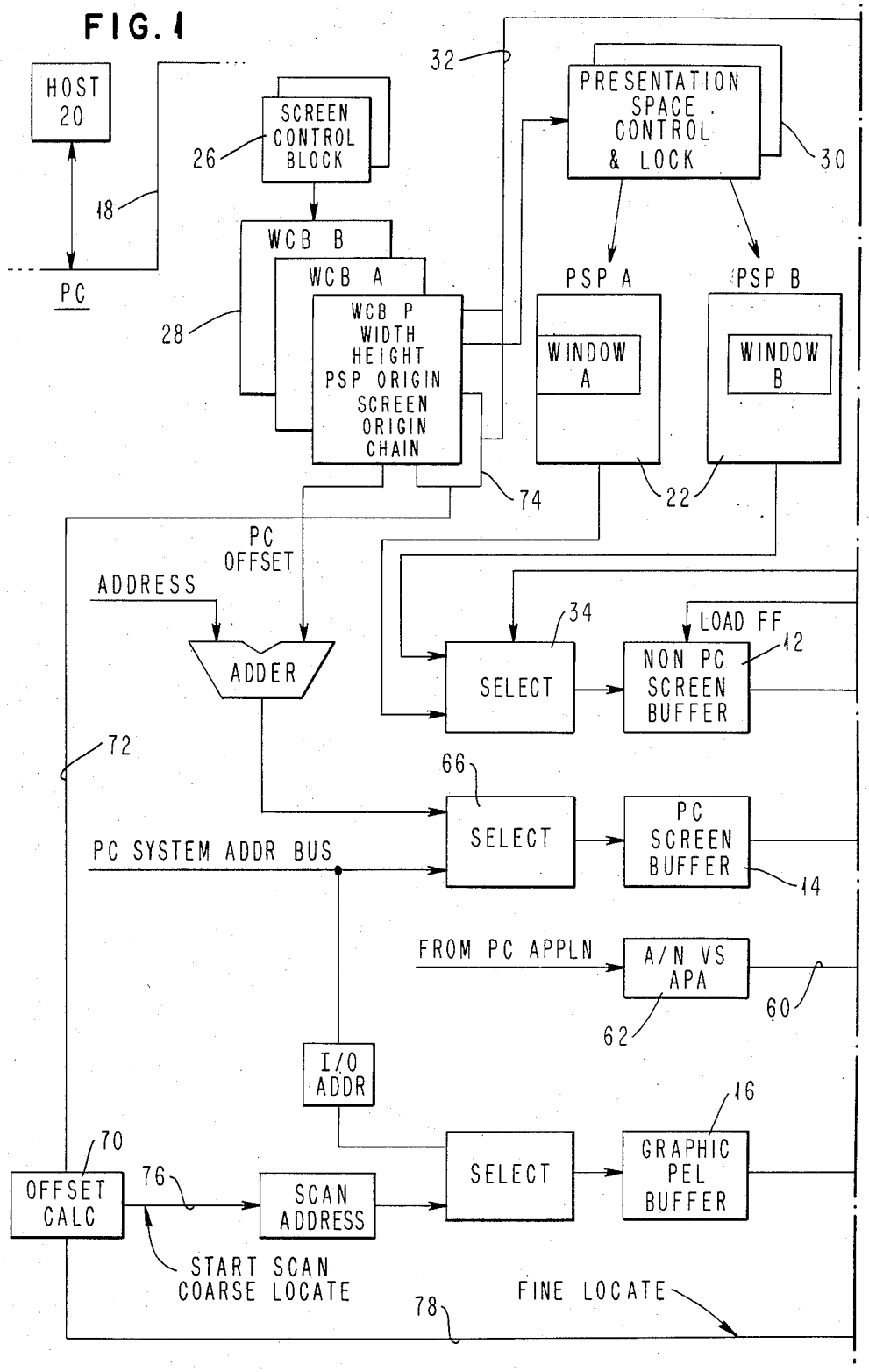
FIG. 1 shows a schematic diagram of a display system embodying the invention.
Figure 1:
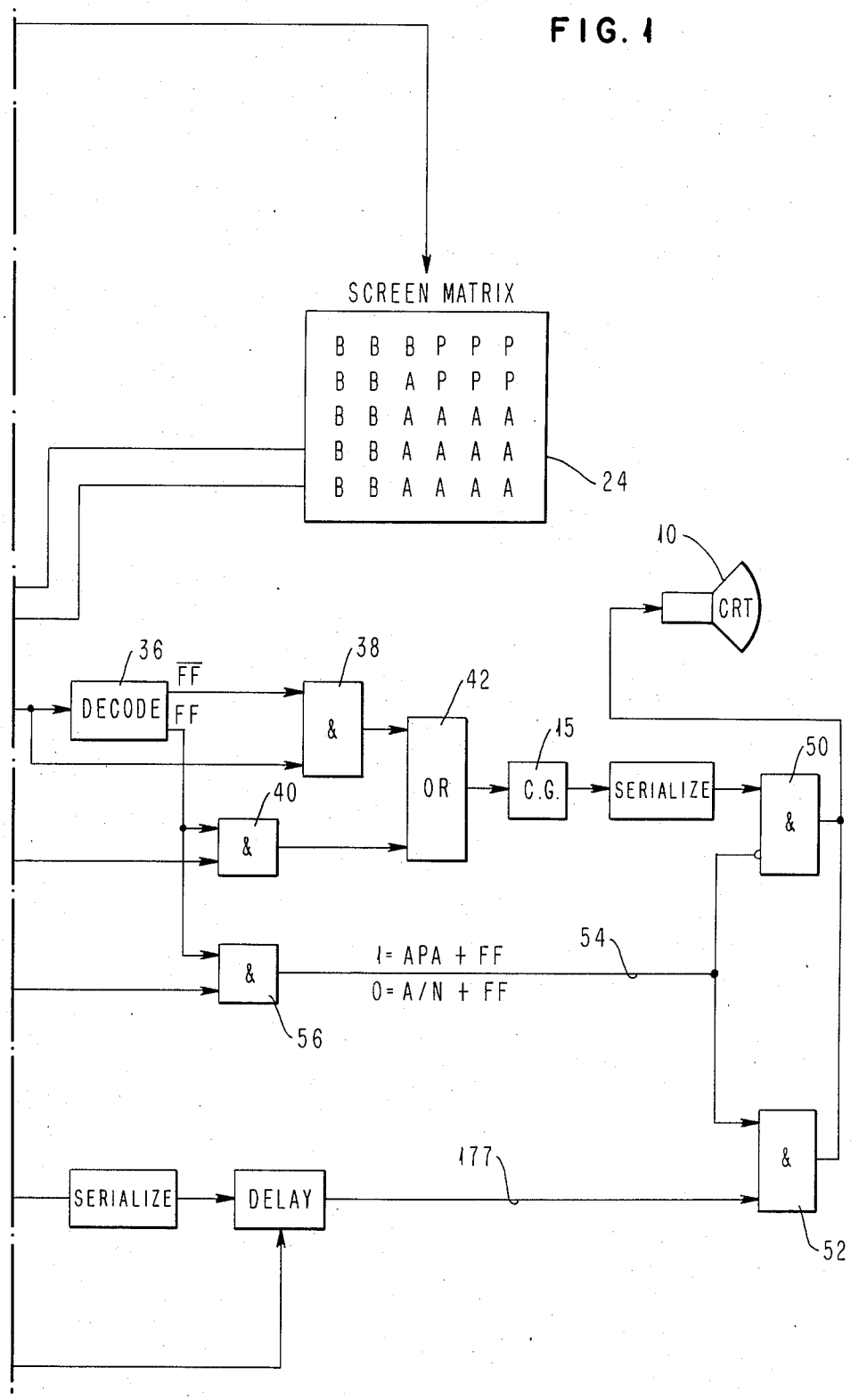

FIG. 1 shows a display system of the kind having plural data sources which can contribute image information for assembly in a composite image on a display screen of, for example, a cathode ray tube (CRT) 10. In the system shown, the information to be displayed comes from synchronously operating buffers 12, 14 which contribute alphanumeric information in coded form for decoding by means of a character generator 15 prior to display on CRT 10. If buffers 12 and 14 have different coding schemes, character generator 15 may actually comprise two or more character generators selectively in parallel. In accordance with the invention, the system also includes a graphics refresh buffer 16 which provides bit data for a graphic display to be shown in lieu of or merged with the alphanumeric display on the screen of the CRT 10. In the illustrated embodiment the graphics buffer 16 is one data bit per picture element (pel) or dot buffer which represents the graphic information to be displayed directly, without the necessity of decoding. However, it will be appreciated that the graphic information could be compressed; for example, it could be of the kind in which one bit is replicated in the display so as to represent two dots or pels and the timings of the system could be correspondingly adjusted to make the one bit into plural pels. Since techniques of this kind of well known further description of such a possible modification need not be given.

In the system shown, the buffers 12, 14, 16 are loaded with display data from various sources. In the illustrated system, one of the alphanumeric buffers 14, receives information from a local personal computer 18 and therefore will be referred to as the PC screen buffer and another of the alphanumeric buffers 12 contains display information derived from a main frame computer or host 20 and therefore will be referred to as the non-PC screen buffer. The host provided information is assembled in the system in presentation spaces A and B shown at 22 in FIG. 1, and windows of such information, shown as window A and window B are loaded on a character basis into non-PC buffer 12 under the control of a screen matrix 24 having a window identifying code position for each of the so-called character box positions at which characters can be shown on the screen of the CRT 10. In the simplified showing of FIG. 1, the character boxes are represented by rows and columns of code positions in which codes, shown as letters in FIG. 1, are recorded for indicating the source of the character codes to be loaded into the non-PC screen buffer 12 from windows A and B of presentation spaces A and B.

The screen matrix 24 also includes codes, shown as P in FIG. 1, indicative of character positions on the CRT screen to be occupied by information derived from the personal computer 18. In accordance with the present invention, this information can be either alphanumeric information which has been loaded in coded form into PC screen buffer 14 by PC 18, or it can be graphic information, for example 1 bit per pel information loaded into pel buffer 16 by the personal computer 18.

The entire operation of loading the buffers 12, 14 and 16, the presentation spaces 22, and the screen matrix 24 is under the control of the processor in the personal computer 18. In the illustrated embodiment, the processor 18 operates under the control of one or more screen control blocks 26 which sets up a set of window control blocks, which via a presentation space control block 30 define the boundaries of the data in presentation spaces A and B constituting windows A and B in 22 and also, via the relationship indicated at 32, set up the screen matrix 24 by which the window data from 22 can be loaded into non-PC buffer 12 as indicated at 34. Wherever one of the window control blocks designates that display information from the personal computer 18 is to be shown, the screen matrix 24 is loaded with a code, shown as a P in FIG. 1, to indicate that fact. The result is that a code hex 'FF' is loaded in the 8-bit byte position in the non-PC screen buffer 12 representative of the position on the screen of CRT 10 corresponding to the position of the "P" in screen matrix 24. The non-PC and PC screen buffers 12, 14 are strobed synchronously with the operation of the display system whereby the raster lines of a display presented by CRT 10 provide successive slices of characters constituting a row on the display, in the matter well known in the art. However when a code hex 'FF' is encountered in the strobing or scanning of non-PC buffer 12, this code is decoded at 36 so as to be blocked at 38 and, instead of being fed to the character generator 15, enables AND circuit 40 to feed a positionally corresponding code from PC screen buffer 14 via 40 and OR circuit 42 to be character generator 15.

In accordance with the present invention, the graphic pel buffer 16 is provided to supply image information alternatively to the alphanumeric information which would otherwise be provided by PC screen buffer 14 to the CRT 10. To provide this function, complimentary gates 50, 52 are interposed between the character generator 15 and the CRT 10 on the one hand and between the graphic pel buffer 16 and the CRT 10 on the other hand. Thus when gate 50 is conditioned, alphanumeric or other character coded information is transmitted from character generator 15 to CRT 10 to show characters presented by codes derived from non-PC screen buffer 12 or PC screen buffer 14, and when gate 50 is deconditioned and gate 52 is conditioned, pel information derived from graphic pel buffer 16 is shown on the screen of CRT 10. Control for this selection of alphanumeric or graphic data for display is provided via control line 54 outputted from an AND circuit 56 which is responsive via one input 58 to the decoding of a hex 'FF' at 36 and to a signal on line 60 provided by a register 62. Thus AND circuit 56 acts to select, via 50 and 52, whether coded (e.g. alphanumeric) or graphic data will be shown in the locations designated by an 'FF' which in turn has been designated by the screen matrix 24 as aforesaid.

To provide the desired flexibility in choosing information to be displayed and locating it with respect to areas of the screen of the CRT, the system illustrated in FIG. 1 includes means to select, moveably, the portions or windows A and B of presentation spaces 22 which are candidates for selection via 34 for loading into the non-PC screen buffer 12, and a refresh address offset adder 64 is provided for altering the scanning or refresh addresses provided by 66 to PC screen buffer 14, also for the purpose of in effect moving the location on the screen of the CRT 10 at which information represented by codes in PC screen buffer 14 can be shown if selected for display via AND circuit 40. Since the information in non-PC screen buffer 12 and PC screen buffer 14 is in coded form, with each character being represented by a code (such as an 8-bit byte) any scrolling or panning of the information to be shown is on a character-by-character (column or row) basis.

In accordance with the invention, a more flexible means of location information on the screen of the CRT or within a viewport on that screen is provided so that the information can be made to pan or scroll on a pel basis that is, on a raster line basis in directions orthogonal to the CRT raster and on a dot basis in the direction parallel to that raster. This operation will be described with reference to FIG. 2 of the drawings.

As aforesaid, in the illustrated embodiment of the invention a graphics image is stored in the graphic pel buffer 16 that operates as a CRT refresh buffer which maps 1-to-1 on a pel basis to the CRT 10 display screen. A viewport may be specified via screen matrix 24 relative to the display screen and, in order to permit any arbitrary similarly sized portion of the stored image to be displayed in the viewport without actually moving data around in the refresh buffer 16, means are provided to start the reading of pel image data from the refresh buffer 16 when the CRT beam is at any arbitrary pel position relative to the CRT screen. By selecting a suitable starting time for reading from the buffer 16, there can be achieved a time displacement of the graphics output data sufficient to bring the upper left pel of the selected portion of the graphics image into time coincidence with the CRT beam when the latter is at the upper left corner of the specified viewport.

Figure 2:
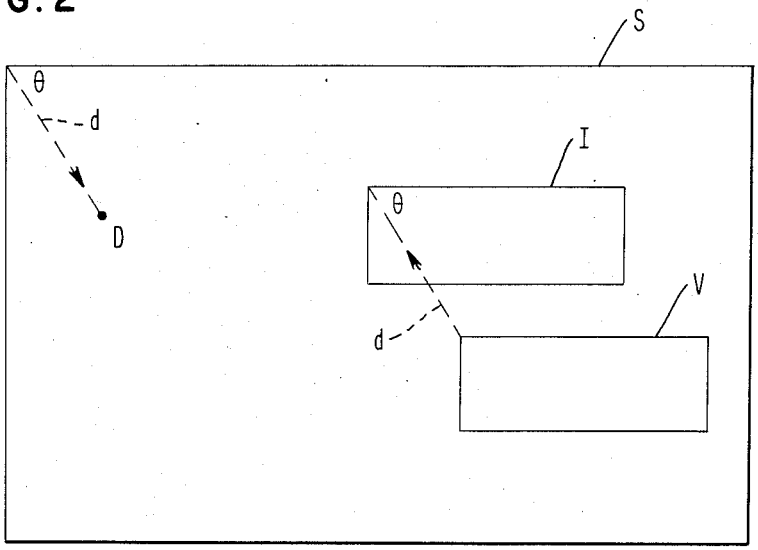
FIG. 2 is a diagrammatic showing of display window relocation in accordance with the invention.

This is shown diagrammatically in FIG. 2 where S represents the screen and pel buffer notionally superimposed, V represents the position of the viewport relative to the screen, and I represents the position of the selected image portion or window relative to the buffer. To simplify this discussion, the buffer is assumed to be coextensive with the screen, although this is not always the case. Also assumed is that CRT 10 operates with a horizontal raster generated top to bottom of the screen. Is is clear that the image I will be displayed in the viewport V if the read-out (from the top left) of the buffer starts when the CRT beam is at the pel or dot position D relative to the screen. However, due to system constraints, the position D cannot be chosen arbitrarily but must lie on a 16-bit (two byte) boundary.

To permit the position D to be chosen to pel accuracy, the system of the invention provides a coarse offset value which specifies the number of two-byte horizontal pel blocks from the upper left corner of the screen to the vertical boundary immediately to the left of the desired pel position D, together with a fine offset value which specifies the number of pels onwards from the vertical boundary to the desired position D.

This offsetting facility is shown schematically in FIG. 1. The coarse and fine offset values are calculated at 70 on the basis of information received via 72 from the Graphic Window control block 74 in the window control block set 28. The resulting coarse and fine control signals are fed on lines 76 and 78 respectively as start buffer scan sync and buffer output delay control signals. The coarse offset value is set into a counter in 70 during vertical retrace of the raster of CRT 10 and the counter is decremented during CRT beam scanning. Read-out from the pel buffer 16 begins when the counter reaches zero. Since this brings the image data out in advance of the desired position D (unless D happens to fall on a 16-bit boundary in buffer 16), the data is delayed by the number of pel periods defined by the fine offset value furnished via 78. This ensures that the first pel in the refresh buffer appears on the screen at the position D.

The fine offset value is provided via 78 in two parts, a pel offset and an odd pel control bit. The pel offset defines the delay as a multiple of two pels and is used for a low resolution mode which uses two bits in the buffer at a time and outputs two identical pels to represent a double wide pel, since in that case the position D need only be specified to an arbitrary two-pel boundary. The odd pel control bit is used to provide an additional single pel delay in the high resolution mode. The coarse and fine offset controls will be described further with respect to FIG. 3.

Figures 3, 3A:
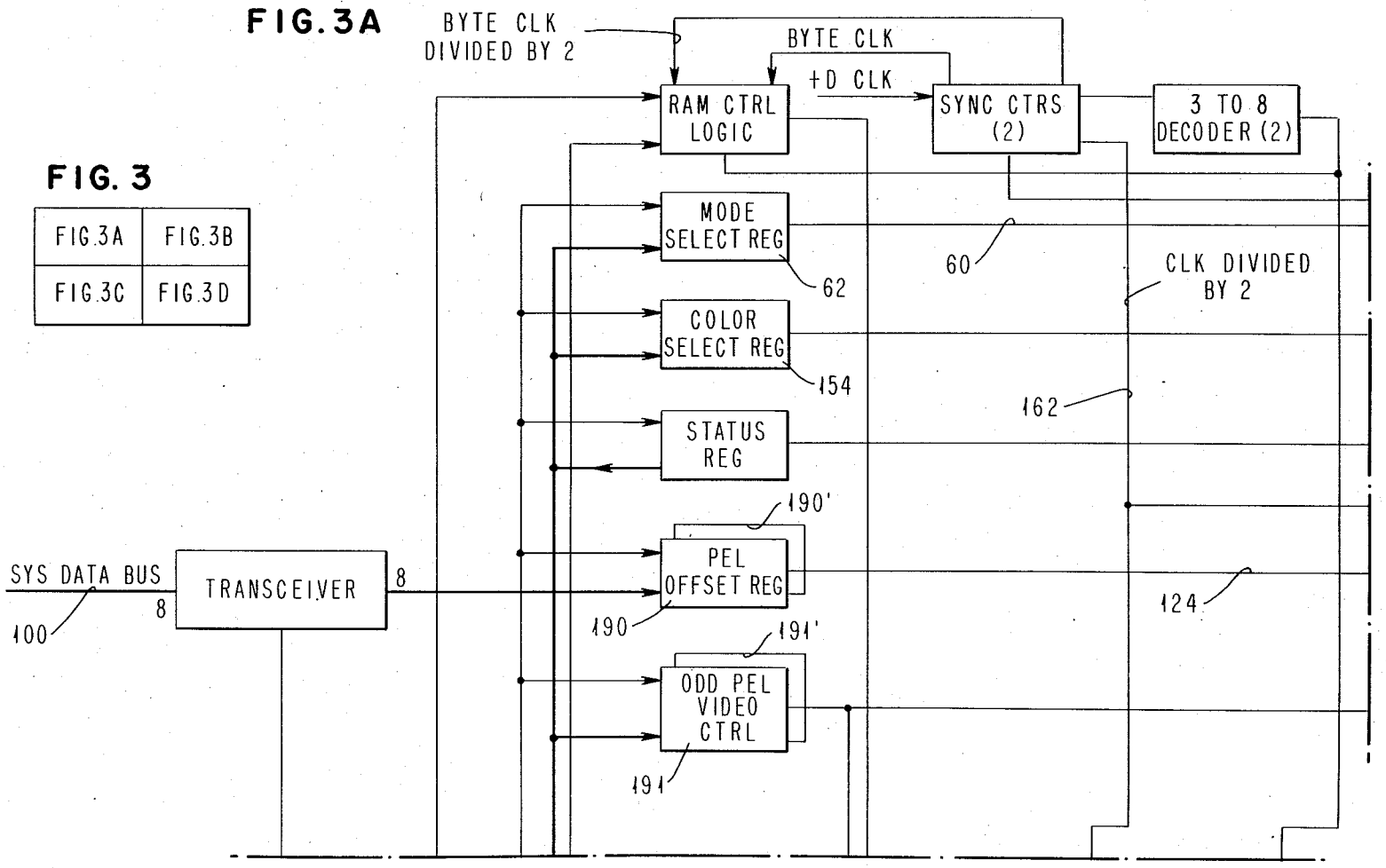
FIG. 3 is a composite figure comprised of FIGS. 3A, 3B, 3C, 3D, which when assembled as shown in FIG. 3 illustrate a preferred embodiment of circuitry for carrying out the method FIG. 2 in the system of FIG. 1.
Figure 3B:
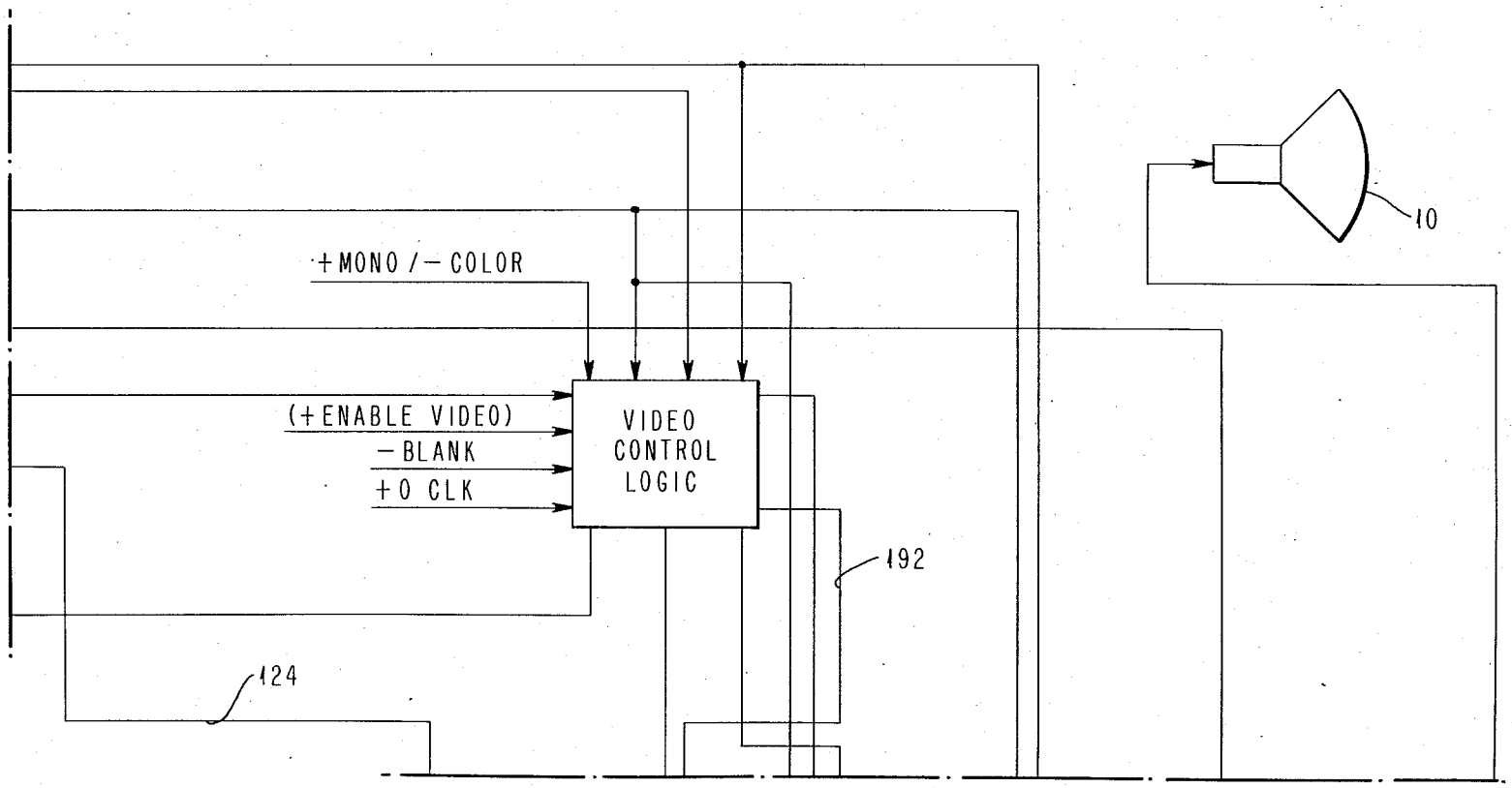
Figure 3C:
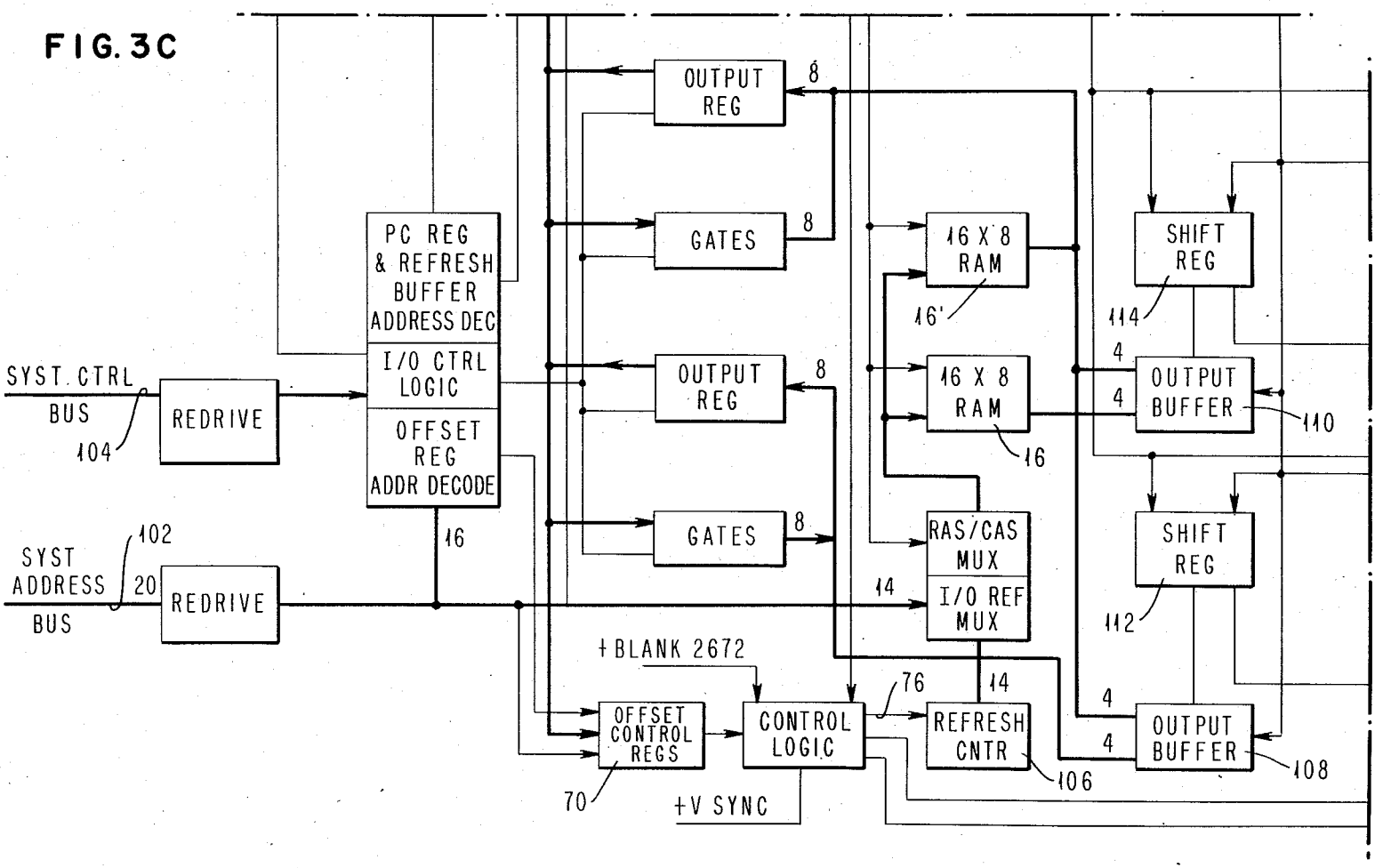
Figure 3D:
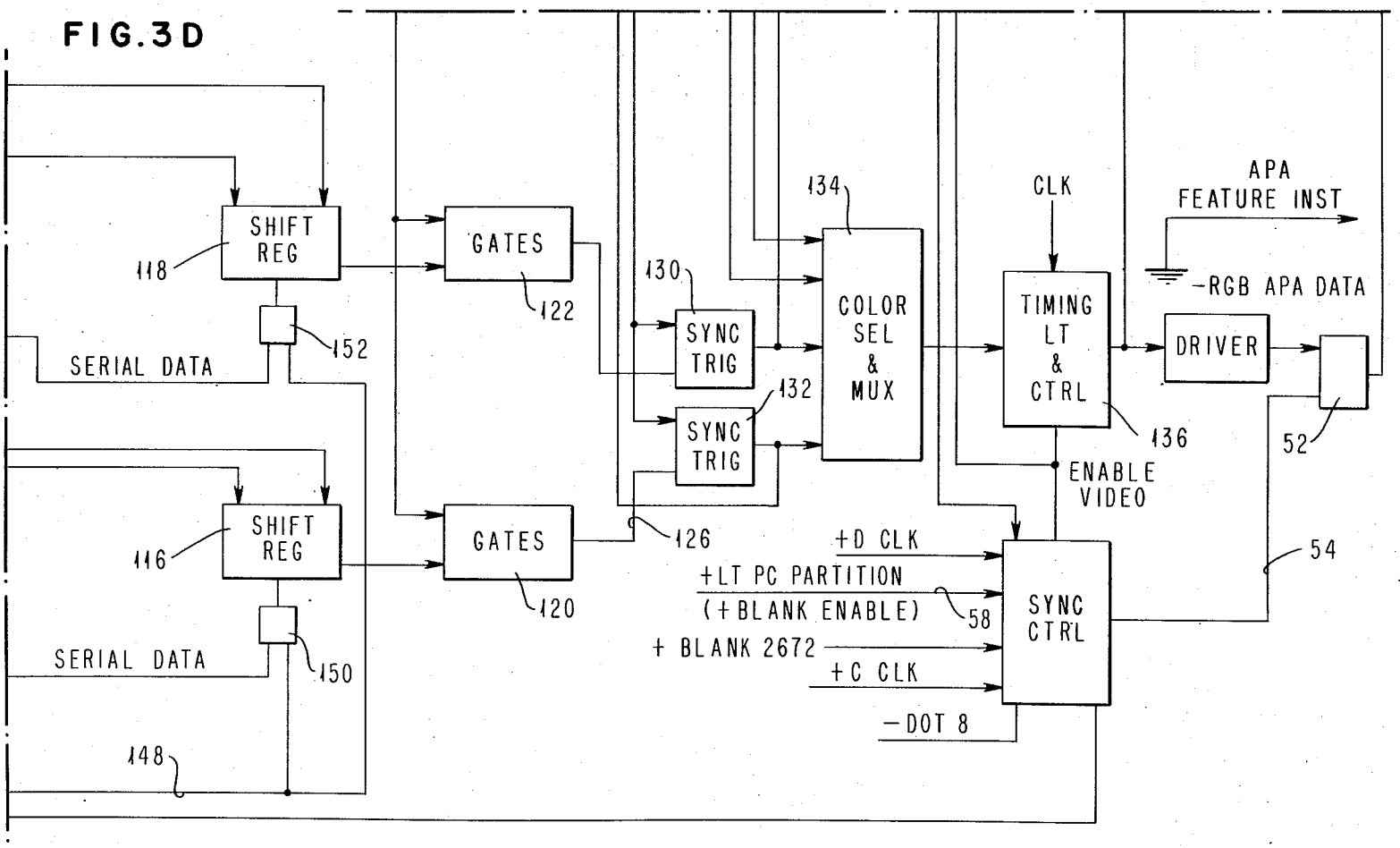

FIG. 3 shows additional details of the graphic pel buffer 16 of FIG. 1, scan address generator for the same, and coarse and fine offset circuitry as above described. In FIG. 3, graphic pel buffer 16 is shown as two 16K×8 bit RAMs 16, and 16' which are employed in alternation to yield a total capacity of 32K×8 or a total of more than one-quarter megabits of storage to provide a display of equal pel resolution. One RAM 16 contains the even numbered bytes and the other one 16' the odd ones. RAMs 16 and 16' are loaded with the desired graphic pel information via system bus 100 at positions therein specified by system address bus 102 under the control of system control bus 104. As is usual with CRT refresh buffers, RAMs 16 and 16' can also be read by the system utilizing the busses 100, 102 and 104. In CRT screen refresh mode, the refresh counter 106 supplies addresses to RAMs 16 and 16' to read out simultaneously a byte from each into respective output buffers 108, 110, the output buffers thus being loaded with even and odd bits, respectively, from the byte pair pointed to by successive even addresses supplied by counter 106. The bytes thus stored in output buffers 108, 110 are then serialized by respective shift registers 112, 114 and the results loaded into respective shift registers 116, 118.

Thus even and odd pel data is made available in registers 116, 118 with a coarse offset with respect to the CRT raster operation. To this coarse offset is added a fine offset value by operation of gate arrays 120, 122. Each of these gate arrays includes 8 gates which are controlled by a signal on line 124 to sample bit positions in registers 116, 118 in succession starting from a variably predetermined point in those shift registers. Thus the outputs from registers 116, 118 selected by the gate arrays 120, 122 are supplied via lines 126, 128 with a variable delay to respective sync triggers 130, 132 for multiplexing and color selection via 134 for supply after retiming and shaping at 136 to gate 52 and thence to CRT 10 when selected by a signal on line 54 as described with reference to FIG. 1. In low resolution mode the even-odd bit pairs are decoded in 134 to yield large pels of variable color. In high resolution mode, the bits of the pairs are interleaved to define one pel per bit, and an additional odd bit of delay is introduced when required at 130, 132.

Figure 4:
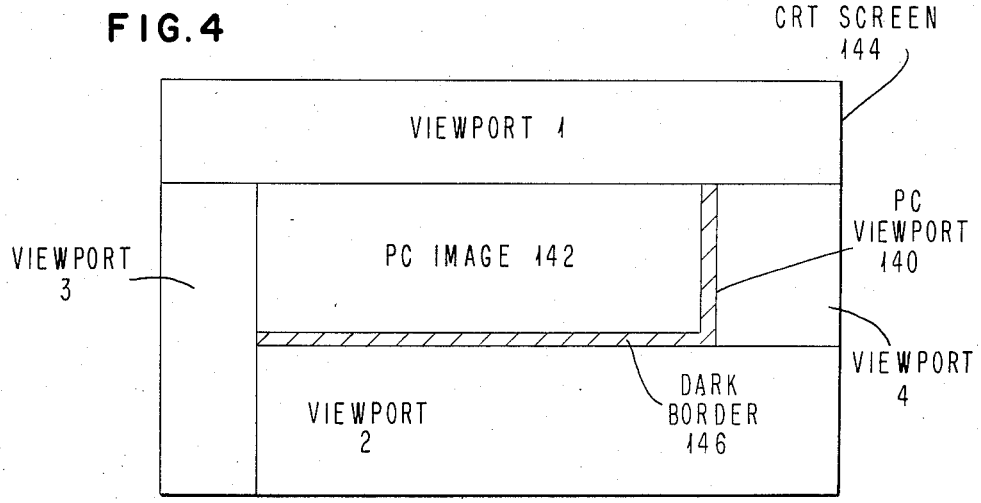
FIG. 4 is a diagrammatic showing of treatment of display window-viewport background mismatch in accordance with the invention.

FIG. 4 shows a situation which can occur when the viewport designated by the screen matrix 24 of FIG. 1 for the PC graphics data extends beyond the edge of the window of pel information available from the graphic pel buffer 16, 16'. This would be the case if it is desired to show the pel image of the entire contents of the graphic pel buffer in a screen viewport which is larger than the pel field available from the pel buffer. This would be the usual case where an array of 9×14 pel character box spaces is assigned by operation of screen matrix 24 to accommodate a graphic pel array which is organized in 8-bit bytes and/or where the height of the pel array is less than some multiple of 14 pels or raster lines provided by the assignment of 14 pel high character boxes for the graphic presentation on the screen. As shown in FIG. 4, the viewport 140 assigned for presentation of the graphic pel image 142 on the CRT screen 144 is larger than the image 142 so that a dark border 146 is present.

In accordance with the invention means are provided to extend the background color of the graphic pel image 142 into the border areas 146 so that the distracting dark border is eliminated. This is accomplished by operation of a signal on line 148 from the offset control calculation circuits 70, FIG. 3, which operates to block, via operation of AND circuit 150, transfer of data from shift register 112 to shift register 116, and, via AND circuit 152, the transfer of bit data from shift register 114 to shift register 118. This results in introduction of zeros in the pel data stream which are shown as background color in accordance with the background color specified for zeros in color select register 154.

Figure 5:
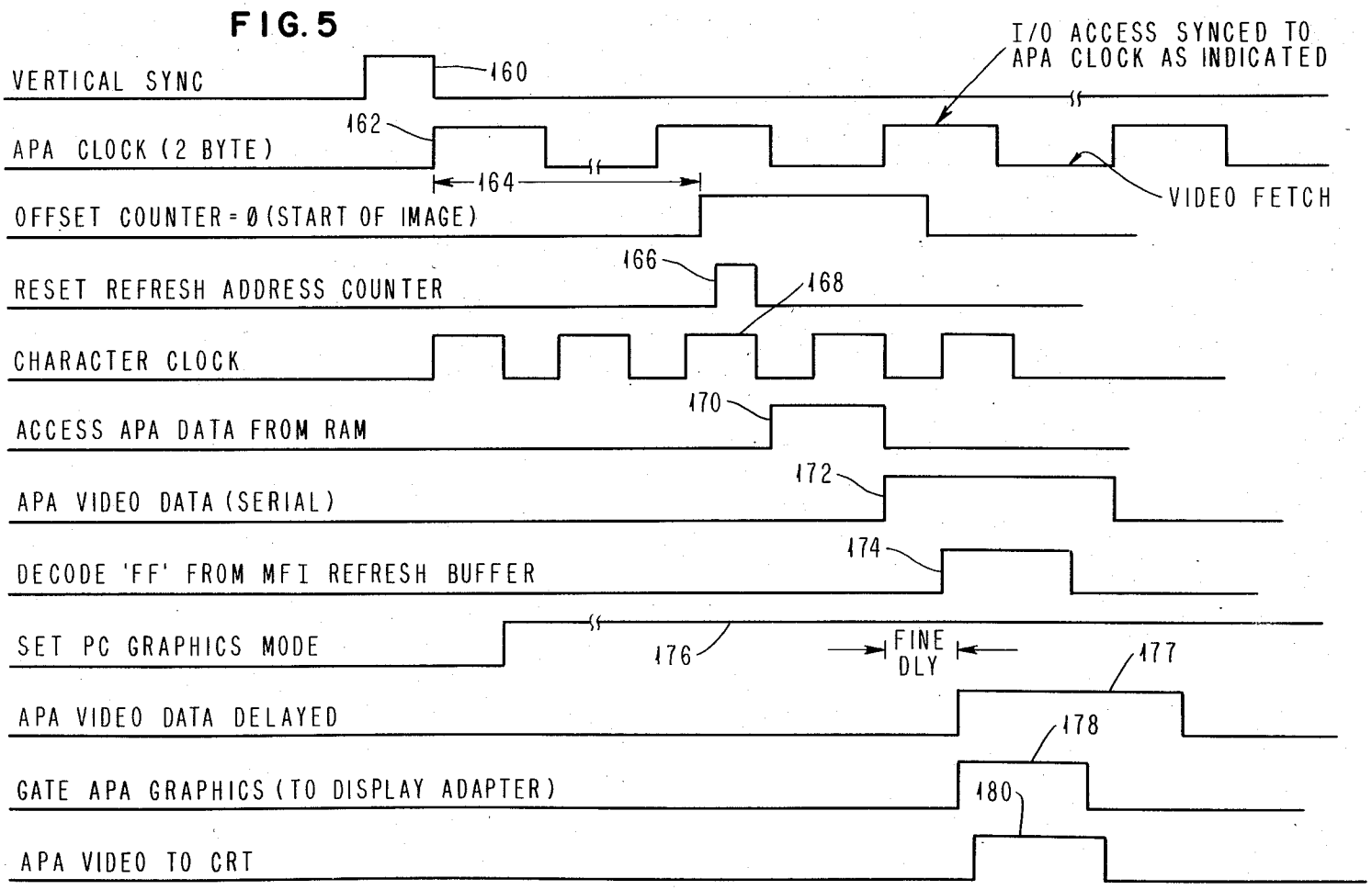
FIG. 5 is a timing diagram schematically illustrative of the operation of input/output, display buffer addressing, and display pel presentation in the operation of the illustrated embodiment of the invention.

FIG. 5 is a timing diagram illustrative, in schematic form, of the operation of the graphics presentation features of the invention. The fall of a vertical sync signal at 160 "unfreezes" the graphic pel clock whereupon, as shown at 162, a two byte length graphics display (APA) clock pulse is initiated and the offset counter/register in element 70 of FIGS. 1 and 3 starts to count down as shown at 164. When a count of zero in that register is reached the refresh counter 106 is reset as indicated at 166 whereby at the next 162 time of the graphics clock, two bytes of data are accessed one from each of RAM 16 and 16' during time 170. The resulting video data is serialized and interleaved into a time period extending over two 8-bit times as shown at 172.

If a hex 'FF' is decoded from the non-PC buffer 12 as indicated at 174 and gate 52 (FIG. 1) is enabled by a signal on line 54, as indicated at 176, then a portion of the video data 172 is gated to the video output circuits with control signal 178 for the duration of 174 and thence to the CRT at 180.

The invention provides the ability to move the graphics image anywhere on the screen in response to a 2-byte start offset value, a one-byte two pel offset value and an odd pel control bit. The latter two operate to provide a delay which yields a vernier or fine offset to accommodate the radix mismatch between the graphic pel data boundaries and the screen matrix character cell boundaries as well as to enable smooth scrolling in any direction.

To recapitulate the image alignment operation, the Start Offset counter 70 is loaded with a value representing the offset of the beginning of the graphics image from the top left corner of the screen in terms of one or more 16 bit half words of data. Following vertical retrace of the CRT beam, this counter is decremented to zero. At this time the graphics subsystem begins accessing the image data from its RAM 16, 16'. Since the image can start anywhere on the screen, the full graphics image must wrap both horizontally and vertically.

The Start Offset counter/register 70 is initialized with a value which centers the image on the screen if the entire screen is used for graphics with only one viewport. Since this value is on a two-byte boundary and not a character boundary some means is needed to shift the image on a pel basis to provide centering capability and minimize gaps between viewports of text and graphics. This is accomplished via the pair of two pel offset registers 116 and 118 and the odd pel control at 130, 132. A bit is loaded into one of the positions of the pel offset register 190. The position of this bit determines the number of pels by which the video data is delayed in terms of two pel units. Medium resolution graphics uses two bits of RAM at a time and outputs two identical pels to represent a double wide pel. Thus scrolling or aligning in medium resolution is on a two boundary and does not require use of the Odd Pel control bit. The Odd Pel control bit is used in high resolution mode, where aligning to a single pel is required. Turning on the Odd Pel control bit via 192 shifts the image one pel to the right. Since the start offset, pel offset and pel controls must be activated at exactly the same time to prevent momentary erroneous shifting of the image, two pel offset and two odd pel registers are used as shown at 190, 190' and 191, 191'. In this implementation control of the exact timing is accomplished in the following way. New values are loaded into the first set of registers from the system bus 100 and then transferred to the second set of registers 190' 191' at the correct synchronized time for use with the CRT refresh. The start offset register 70 is loaded last. The new start offset value is used after the next vertical retrace. The transfer of the pel offset and odd pel registers occurs when the start offset counter reaches zero and the new image begins. Control logic synchronizes the exact starting time to also match delays in the logic so that the start occurs at the correct pel.

Figure 6:
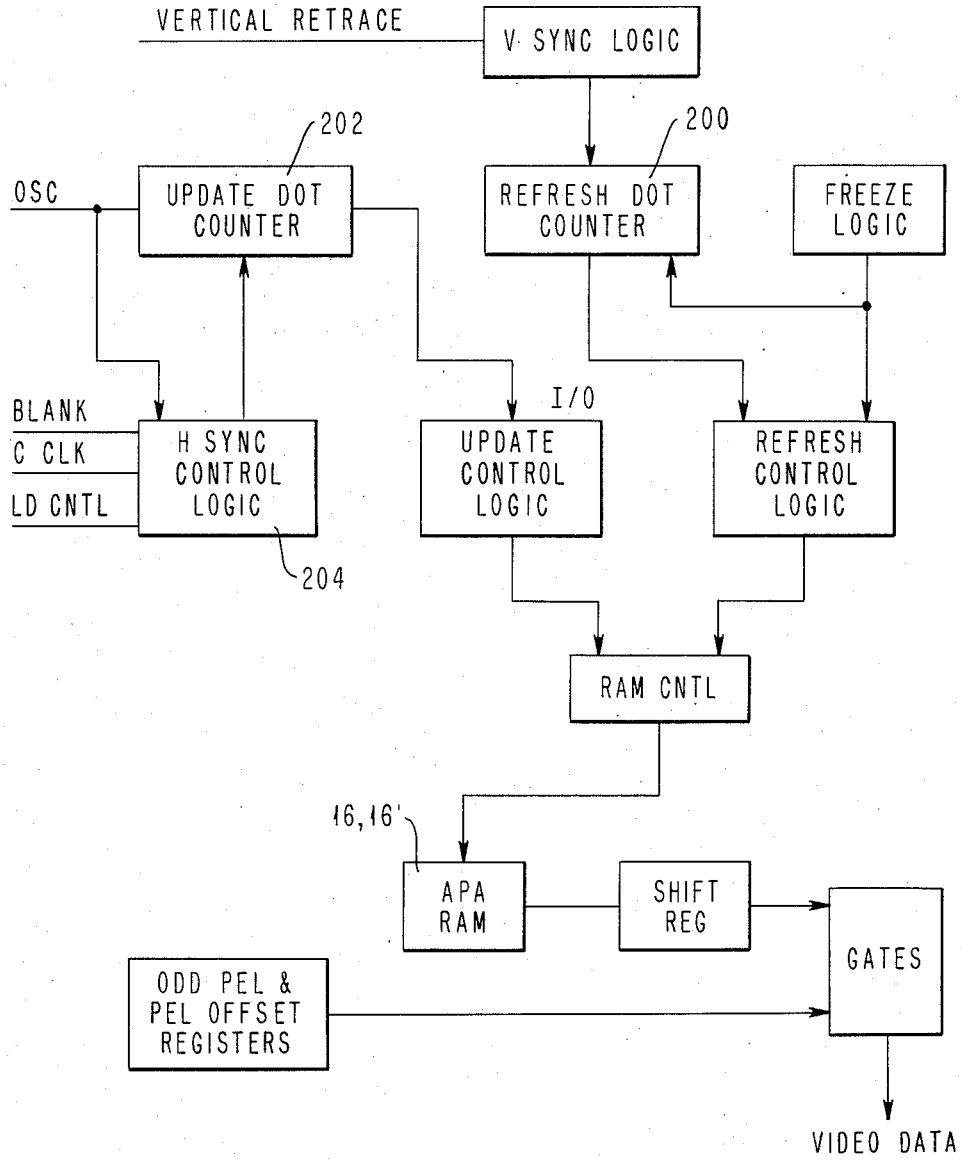
FIG. 6 is a detailed diagram of a portion of the schematic diagram of FIG. 3, showing means for freeze and resynchronize input/output and display timing means in accordance with the invention.

Another feature of the invention relates to means to control the starting and stopping of video data at the image boundaries by means of a freeze control logic, as shown in FIG. 6. The ability to continuously update the data in the graphics RAM 16, 16' is provided by using alternate update and image refresh cycles. This implies accessing enough refresh data at a time to allow an update cycle in between refresh cycles. In the illustrated embodiment, a two bytes wide refresh bus is in effect, provided. Continuous update capability is provided during both active display time and retrace time. Thus timing counters and clocking are made available at substantially all times in order to do the RAM update and other read/write functions.

It will be recalled that, to provide graphics image shifting on a pel basis (i.e. relocation of the image to any location on the screen), the system includes means for the starting and stopping of the display of the graphic image at the screen boundaries precisely on any pel. That is, when the image is shifted some number of pels, the logic must be able to stop display exactly on one pel. Shifting the image by controlling the timing requires using a counter that can be stopped during retrace time.

To solve both of the above problems two dot counters 200, 202 are used, one to control refresh and the other to control update. Since the CRT raster blank time (retrace) can be any random time and different for different monitors with different blank times, the two counters are synchronized in each scan line. The graphic circuits are also resynchronized to the operation of the rest of the display system (e.g. FIGS. 1, 12 and 14) that controls character text functions to prevent shifting of the two images by some number of pels. This resynchronization is accomplished every vertical retrace time by setting the graphic refresh dot counter 200 to a fixed value.

Horizontal synchronization control logic 204 generates a signal based on the blank, character clock, load control, and dot clock oscillator from the text display which freezes the refresh timing counter and refresh RAM 16, 16' to stop the graphic image at the right edge of the screen. The refresh timing counter in turn freezes all the graphic scrolling and video control logic at a precise pel location. The same control logic unfreezes the counter and control logic at the correct time for the image to begin being displayed starting at the left side of the screen. During the retrace time, the update counter 202 and memory controls are still active, allowing graphic RAM reading and writing. When the refresh dot counter 200 is activated (at the start of the next scan line), the update dot counter 202 is halted at a specific value until the refresh counter reaches that same value. At this time both counters are in synchronization and the update counter is allowed to continue.

During vertical retrace, control logic resets the refresh counter to a specified value which exactly synchronizes the graphics image to the same starting pel count as the associated text display. Thus the freeze control logic is operative to start and stop the refresh dot counter 162 while allowing continuous update of the graphic pel RAM 16, 16' by means of a separate dot counter. Synchronization of the separate dot counters for each scan line by means of the control logic causes the update counter to pause at a specific value until the refresh counter reaches that value.

I claim:

1. A method of operating a display system for displaying a window of data from a pel buffer in a viewport on a display screen, wherein the display system includes first means defining the window with respect to the buffer and second means defining the viewport with respect to the screen, characterized in that the first and second means operate on different radices, and in that the method comprises chossing a viewport at least as large as the window of data to be displayed, scanning the buffer and the screen at integrally related pel rates, modifying the buffer addressing to bring the window of data approximately into desired registration with the viewport subject to the constraints imposed by the said different radices, and providing a variable delay in the application of the pel data from the buffer to the screen to bring the window exactly into desired registration with the viewport.

2. The method of claim 1, additionally including the step of filling in a gap between the window and a boundary of the viewport with an extension of the pel background of the window.

3. The method of claim 2, additionally including the steps of providing access times to update the buffer interleaved with fetching of data from the buffer in the scanning of the window therein, the access times being synchronized to the scanning to accommodate differences in the timing of the access and fetching operations.

4. The method of claim 1, additionally including the steps of providing access times to update the buffer interleaved with fetching of data from the buffer in the scanning of the window therein, the access times being synchronized to the scanning to accommodate differences in the timing of the access and fetching operations.

* * * * *